US006325214B1

(12) United States Patent
Smithson

(10) Patent No.: US 6,325,214 B1
(45) Date of Patent: Dec. 4, 2001

(54) BAG STACK AND DISPENSER

(75) Inventor: Martin Dominic Smithson, Malvern (GB)

(73) Assignee: Cascade Dispensers Limited, Worcestershire (GB)

( * ) Notice: Subject to any disclaimer, the term of this patent is extended or adjusted under 35 U.S.C. 154(b) by 0 days.

(21) Appl. No.: 09/406,202

(22) Filed: Sep. 27, 1999

(30) Foreign Application Priority Data

Apr. 29, 1999 (GB) ..... 9909908

(51) Int. Cl.[7] ..... B65D 33/14
(52) U.S. Cl. ..... 206/554; 383/9; 383/37
(58) Field of Search ..... 206/554; 248/97, 248/99, 100; 383/8, 9, 37

(56) References Cited

U.S. PATENT DOCUMENTS

| | | | | |
|---|---|---|---|---|
| Re. 33,264 | * | 7/1990 | Baxley et al. | 206/554 |
| 4,480,750 | * | 11/1984 | Dancy | 206/554 |
| 4,529,090 | * | 7/1985 | Pilon | 206/554 |
| 4,676,378 | | 6/1987 | Baxley et al. . | |
| 4,785,938 | | 11/1988 | Benoit, Jr. et al. . | |
| 4,811,417 | | 3/1989 | Prince et al. . | |
| 4,812,055 | | 3/1989 | Prader et al. . | |
| 4,981,216 | | 1/1991 | Wilfong, Jr. . | |
| 4,989,732 | | 2/1991 | Smith . | |
| 5,087,234 | | 2/1992 | Prader et al. . | |
| 5,183,158 | | 2/1993 | Boyd et al. . | |
| 5,213,145 | | 5/1993 | Huang et al. . | |
| 5,333,730 | | 8/1994 | Boyd . | |
| 5,507,713 | | 4/1996 | Glod, Sr. et al. . | |
| 5,561,967 | * | 10/1996 | Nguyen | 206/554 |
| 5,630,779 | | 5/1997 | Glod et al. . | |
| 5,662,225 | * | 9/1997 | DeMatteis | 206/554 |
| 5,799,793 | | 9/1998 | Glod, Sr. et al. . | |
| 5,881,882 | * | 3/1999 | Fletcher et al. | 206/554 |
| 5,979,655 | * | 11/1999 | Tseng et al. | 206/554 |

FOREIGN PATENT DOCUMENTS

| | | |
|---|---|---|
| 2309957 | 8/1997 | (GB) . |
| 2329629 | 3/1999 | (GB) . |
| 2334944 | 9/1999 | (GB) . |

* cited by examiner

*Primary Examiner*—Luan K. Bui
(74) *Attorney, Agent, or Firm*—Garrison & Associates PS; David L. Garrison

(57) ABSTRACT

A stack of plastic T-shirt type bags for use with a dispenser. Each bag in the stack has a pair of handles with aligned apertures for receiving the prongs of the dispenser. The stacks are retained in alignment by a releasable flap on the periphery of the aperture in each aperture integral with the bag. The stack provides for the releasable securement of adjacent flaps together for retention of bags in overlying aligned relation in the stack. Each bag has at least one discrete region of weakness between each aperture and the inward side of the respective handle stack which can be broken for detachment of a bag from the dispenser. The stack is adapted to dispensers with prongs carrying surface projections (i.e. transverse ridges) to restrict unwanted sliding of the stack along the prongs.

17 Claims, 4 Drawing Sheets

BAG STACK AND DISPENSER

REFERENCE TO RELATED APPLICATION

This application claims the benefit of United Kingdom Patent Application No. 9909908.7, entitled Novel Bag Stack and Dispenser, and filed Apr. 29, 1999.

FIELD OF THE INVENTION

This invention relates to a novel stack of individual pre-formed bags for use with dispensers for dispensing such bags individually from the stack. Such stacks are also known as bag-packs, particularly in the United States. The invention also relates to novel dispensers for bag stacks.

BACKGROUND OF THE INVENTION

It is common practice to provide, for example in supermarkets and other retail outlets, dispensers for dispensing pre-formed bags (e.g. plastic bags) from a stack of such bags.

A simple known system hangs a stack of T-shirt type handle bags from two substantially horizontal support rods. For example, U.S. Reissue Pat. No. 33,264 (Baxley et al; Jul. 17, 1990), the disclosure of which is incorporated herein by reference, describes an arrangement (illustrated in FIG. 1 of the accompanying drawings) in which each bag is provided with two support rod receiving apertures in its handle portions 1, such that the apertures pass through the stack of bags 2 and receive the support rods 3, 4. The stack of bags 2 is also provided with a bonded block ("header") of detachable mounting tabs which extends from a central area of a mouth portion of a bag and is provided with a mounting aperture 5. The dispenser takes the form of a metal frame having two rods projecting forwards to provide the support rods 3, 4, and having a shorter hook element 6 projecting between the support rods 2,3 to receive in use the mounting aperture 5 of the bonded block of mounting tabs. The central bonded block of detachable mounting tabs can be omitted (FIG. 5 of U.S. Pat. No. Re. 33,264). The support rod receiving apertures can be formed by a generally C-shaped cut in each handle portion 1, which defines a flap lying across the aperture of the respective handle of the respective bag. Before hanging the stack of bags on the dispenser the flaps substantially close the apertures of the stack. On engaging the stack of bags on the support rods the support rods push the flaps down and thereby open the support rod receiving apertures (FIGS. 3 and 8 of U.S. Pat. No. Re. 33,264). The flaps are permanently heat sealed together, as indicated by numeral 44 in FIG. 3 of U.S. Pat. No. Re. 33,264 and the associated description.

The bags of the stack 2 can be adhesively bonded together via spots or regions of adhesion, whereby the act of drawing one bag forward along the support rods 3, 4 will cause the next following bag to partially open (FIG. 2 of U.S. Pat. No. Re. 33,264). After the first bag has been loaded it is lifted forwardly off the support rods 3, 4 and the adhesive bond broken to detach the bag from the dispenser. The flaps are broken away and the broken-off flaps are left on the dispenser, still heat-sealed to the flaps of the next bag of the stack.

In another form of such a system, U.S. Pat. No. 4,811,417 (Prince et al; Mar. 7, 1989), the disclosure of which is incorporated herein by reference, describes a form of bag stack in which an elongate vertical slit provides the support rod receiving aperture of each handle of the stack of bags and the handles are maintained in alignment in the stack by means of releasable heat welds holding the end of each handle to its neighbour in the stack.

U.S. Pat. No. 4,981,216 (Wilfong; Jan. 1, 1991), the disclosure of which is incorporated herein by reference, describes a further form in which a front part of the handle is detachable from the support rod to assist in opening the mouth of the first bag for loading.

The known systems suffer from various inherent disadvantages. The act of lifting the loaded first bag, forward and off the support rods, is itself awkward and potentially straining when performed repeatedly many times a day in a seated position. The use of aperture flaps which are permanently heat-sealed together is inconvenient in the act of loading a stack of bags onto the dispenser, and results in a block of redundant flaps, which must be discarded, as the stack is consumed. The use of a central block of mounting tabs from which the bags are detached, while serving to maintain the integrity of the stack before use, is wasteful of plastic, as the block is thrown away after the last bag of the stack has been used. Moreover, the webs connecting the bags to the block are prone to break as the block is being engaged onto the hook element of the dispenser, thereby causing the bags to "daisychain" or pull forward prematurely from the stack before the first bag has been removed, as described in our British Patent Application No. GB-A-2309957.

It is an aim of the present invention to go at least some way towards overcoming the disadvantages of the previously known systems, or at least to provide an acceptable alternative system.

DESCRIPTION OF THE INVENTION

According to a first aspect of the present invention, therefore, there is provided a stack of individual pre-formed bags for use with bag dispensers of the type in which at least one (e.g. two laterally spaced) elongate support member of the dispenser passes in use through at least one support member receiving aperture defined by corresponding portions of the stack and thereby supports the stack, the stack comprising a plurality of stacked T-shirt type bags, each bag comprising front and rear, preferably gusseted, walls, a closed bottom and an open mouth top portion, the open mouth portion being preferably (but not essentially) free of any integral extension header at the top of the front and rear walls; the top portion having a pair of spaced loop handles as integral extensions of the walls at opposite sides of the mouth; the plurality of stacked bags being positioned with the corresponding handles of the pair of handles of each bag in stacked aligned overlying relation forming a pair of handle stacks associated with the stacked bags; and aligned support member receiving apertures being provided through the handles of at least one (preferably each) handle stack for reception of the respective handle stack on a corresponding support member of the dispenser receivable through the aligned apertures; the handles in the respective handle stack being retained together for maintaining the apertures in alignment by bag retaining means which comprise a flap within each aperture of each bag of the handle stack integral with the respective bag at a minor region on the periphery of the aperture; characterised in that the flaps of the apertures of one bag in the handle stack are releasably secured to the flaps of the apertures of the adjacent bags, for retention of the flaps in overlying aligned relation prior to removal of a bag from the dispenser, and for release of the flaps of a first bag of the stack from the flaps of the remainder of the stack on pulling the bag away from the stack.

In contrast to the arrangement of, for example, U.S. Pat. No. Re. 33,264, the flaps of the apertures in the or each handle stack in the bags of the present invention are not severed during the action of removal of a bag from the dispenser, with the desirable result that, provided that no integral extension header is present at the top centre of the walls of the bags, no waste bag material is left on the dispenser or the last bag of the stack.

It is particularly preferred that the support member receiving apertures are provided nearer the inwardly directed sides of the handles than the outwardly directed sides of the handles, and generally intermediate between the base and end of the handles.

It is preferred that the flaps have a length to width ratio of at least about 1:1, more preferably between about 2:1 and about 6:1, with the result that in this most preferred form the flaps take the form of generally elongate tongues (e.g. about 3–4 cm long and about 1 cm wide) and the apertures generally elongate slots of corresponding size.

The inwardly directed sides of the handles are suitably configured so that the apertures are located generally in line with the inwardly directed side of the respective handle at the base of the handle. The inwardly directed sides of the handles are suitably configured to provide aligned tabs extending from the inwardly directed sides of the handles and which are integral with the handles and together with the handles define the periphery of the support member receiving apertures.

In one particular embodiment, at least one discrete region of weakness is provided in each handle stack between the periphery of the support member receiving aperture and the side or end of the handle (preferably the inwardly directed side of the handle). Preferably one region of weakness is provided near the top of each aperture. The or each region of weakness is suitably provided by a localised narrowing (e.g. to between about 1 and 6 mm, e.g. about 2–5 mm) of the web of bag material between the periphery of the respective support member receiving aperture and the inwardly directed side of the handle.

By providing at least one region of weakness in the handle adjacent each support member receiving aperture, the front bag of the stack can be pulled downwardly off the dispenser by breaking the web of bag material at the region of weakness.

According to the first aspect of the invention the flaps comprising the bag retaining means are releasably secured to adjacent flaps. The releasable securement is preferably effected by blunt rough edged or serrated punch welding in which a punch is brought sharply down onto the aligned stack of flaps against an anvil to secure them releasably together by means of the deformation caused by the punch.

The first aspect of the invention described above can, if desired, be modified by providing for the minor region of integrality between each flap and its bag to be preferentially weaker than the securement between the adjacent flaps, whereby the minor region of integrality will tend to break when a bag is detached from the stack. The result of this may be a gradual accumulation of flaps in a block, which may remain attached to the final bag of the stack when it is removed from the dispenser by pulling downwards on the bag to break each region of weakness in the handles adjacent the support member receiving apertures. However, the block of flaps will be easily broken up, and in many cases will not accumulate in this way. Such a modification may therefore be acceptable environmentally, as there is still no redundant stock of bag material left on the dispenser after removal of the last bag.

The use of a frangible region of weakness in the handle adjacent each support member receiving aperture is of general applicability and itself constitutes a second aspect of the present invention.

In a second aspect of the present invention, therefore, there is provided a stack of individual pre-formed bags for use with bag dispensers of the type in which at least one (e.g. two laterally spaced) elongate support member of the dispenser passes in use through at least one support member receiving aperture defined by corresponding portions of the stack and thereby supports the stack, the stack comprising a plurality of stacked T-shirt type bags, each bag comprising front and rear, preferably gusseted, walls, a closed bottom and an open mouth portion, the open mouth portion being preferably (but not essentially) free of any integral extension header at the top of the front and rear walls; the top portion having a pair of spaced loop handles as integral extensions of the walls at opposite sides of the mouth; the plurality of stacked bags being positioned with the corresponding handles of the pair of handles of each bag in stacked aligned overlying relation forming a pair of handle stacks associated with the stacked bags; and aligned support member receiving apertures being provided through the handles of at least one (preferably each) handle stack for reception of the respective handle stack on a corresponding support member of the dispenser receivable through the aligned apertures; the handles in the respective handle stack being retained together for maintaining the apertures in alignment in such a way that preferably no residual material is left detached from the handle of one bag on pulling the said one bag away from its neighbour in the stack, characterised in that at least one discrete region of weakness is provided in each handle of the respective handle stack between the periphery of the support member receiving aperture and the side or end of the handle (preferably the inwardly directed side of the handle), whereby on pulling a bag from the dispenser the material of the bag breaks at the at least one region of weakness in the handle to detach the handle of the bag from the support member of the dispenser.

The handles in at least one (preferably each) handle stack may preferably be retained together for maintaining the apertures in alignment by conventional means for releasably fixing the handles in generally orderly stacked registration, for example heat bonding (e.g. hot pin welding).

The means for retaining the handles of a handle stack together may, for example, comprise flaps within each aperture integral with the bag at a minor region on the periphery of the aperture. The flaps are preferably releasably or non-releasably secured to adjacent flaps of the stack for retention of the flaps in overlying aligned relation prior to removal of a bag from the dispenser. Releasable securement is preferred, in accordance with the first aspect of the present invention.

If the flaps are releasably secured together, then on pulling a bag from the dispenser the material of the bag breaks at the at least one region of weakness in each handle stack and the flaps of the bag release from the flaps of its neighbour (but stay integral with the bag being pulled from the dispenser). If, on the other hand, the flaps are non-releasably secured together, then on pulling a bag from the dispenser the material of the bag breaks at the at least one region of weakness in each handle stack and the flaps break away from the bag being pulled from the dispenser by reason of breakage of the bag material at the minor region on the periphery of the aperture. The broken flaps then remain secured to the neighbouring flaps which are integral with the neighbouring bag of the stack.

The bags of the present invention are suitably manufactured in generally conventional manner. A thermoplastic tube, for example of a polyethylene or other polymer film, is simultaneously collapsed and gusseted so that the gussets extend inward from the sides. This collapsed and gusseted tube is, thereafter, sealed and severed transversely at intervals along its length along lines which ultimately constitute seals at the bottom of the bags and at the ends of the handles, respectively. This results in the formation of a structure which can be considered as inwardly gusseted double end-sealed enclosures, or so-called "pillow cases". Thereafter, a plurality of these end sealed "pillow cases" are stacked one upon the other, optionally with the provision of regions or spots of adhesion between the adjacent "pillow cases", and a suitably designed cutting die cuts through the stack and simultaneously forms the handles and mouth area. The support member receiving apertures may be formed simultaneously with this cutting or during a subsequent step, as may be the securement of the flaps of the bag retaining means. Any desired hot pin welding or other pin perforation of the bags can also be performed on the stack.

It has been found in practice that the retention of the parts of the stack in overlying aligned relation prior to removal of a bag from the dispenser can be improved by the parts adjacent to any line of cutting or point of perforation being made to snag or foul their corresponding parts of neighbouring bags. This snagging or fouling can be obvious to the naked eye or may be visible only under magnification. The use of such snagging or fouling can be adapted to be one—even the sole—means for retaining the bags of the stack and/or their handles in alignment (and thereby the support member receiving apertures in registration) prior to removal of a bag from the dispenser, and most particularly prior to and during loading of the stack of bags onto the dispenser.

Thus, for example, the discrete region of weakness provided in each handle stack between the periphery of the support member receiving aperture and the side or end of the handle, according to the second aspect of the present invention, can be formed by a V-notch or an I-slit cut through that portion of the stack and that cut can be formed using an irregular blade, to encourage snagging or fouling of the webs of bag material at the cut, as described above. A perforating pin may correspondingly be provided with surface irregularities. The surface irregularities of the blade or pin can be visible to the naked eye, or visible only under magnification. The surface irregularities may suitably take the form of slight serrations, which may be in line with the direction of travel of the blade or pin or angled away from the direction of travel.

The use of a slightly serrated blade or pin to form at least some of the lines of cutting or points of perforation during manufacture of stacks of individual pre-formed bags of the T-shirt type is new and itself constitutes a third aspect of the present invention.

In a third aspect of the present invention, therefore, there is provided a method of manufacturing a stack of individual pre-formed bags comprising a plurality of stacked T-shirt type bags, each bag comprising front and rear, preferably gusseted, walls, a closed bottom and an open mouth top portion; the top portion having a pair of spaced loop handles as integral extensions of the walls at opposite sides of the mouth; the plurality of stacked bags being positioned with the corresponding handles of each bag in stacked aligned overlying relation forming a pair of handle stacks associated with the stacked bags; the method comprising:

(a) forming a stack of double end-sealed bag-forming enclosures; and (b) applying at least one cutting blade or perforating pin to the stack of bag-forming enclosures to cut the open mouth top portion and the handles therefrom or to form perforations therein;

characterised in that at least a portion of the cutting blade or perforating pin is provided with surface irregularities which cause the material of one bag in a region adjacent the resulting cut or perforation to at least partially snag or foul the material of a neighbouring bag or group of bags adjacent the same cut or perforation, whereby at least some of the bags of the stack are releasably secured together. Stacks of bags made using this method are also covered by this aspect of the present invention.

The surface irregularities are preferably at least about 0.01 mm in depth, more preferably at least about 0.1 mm and most preferably at least about 0.2 mm. The surface irregularities are preferably no more than about 1 mm in depth.

The method of the third aspect of the present invention may, for example, be employed in the manufacture of stacks of bags according to the first and second aspects of the present invention. It is most preferred that the snagging and fouling of material of adjacent bags should be encouraged at the edges of the support member receiving apertures and the handle parts.

The stacks of bags according to the present invention are particularly suitable for use in the dispensers described and claimed in our UK Patent Applications Nos. GB-A-2309957 and GB-A-2334944 (the disclosures of which are each incorporated herein by reference), with minor modifications to the catch means of the earlier dispensers as will be readily apparent to those skilled in the art. In those prior applications, in general the dispenser comprises a body part and an anchor part for the stack disposed on the body part, the anchor part comprising catch means (e.g. stack support members) for engaging the stack whereby the stack depends from the catch means for being grasped for removal, and a stack restraining means comprising an elongate member associated with the dispenser and movable (e.g. pivotably) between a first position in which a first portion of the elongate member bears against the stack to restrain the same and a second position in which the elongate member is deflected from its first position against the action of a restoring force to permit the front wall of a first bag of the stack to be drawn past the stack restraining means to open the said first bag for loading prior to removal from the dispenser.

It is most preferred that the said drawing of the front wall of the first bag of the stack past the stack restraining means to open the bag for loading is accomplished, via a glue spot or similar region of adhesion between adjacent bags of the stack, by the act of removal of the previous bag from the dispenser. For this purpose, the stack of bags is preferably provided with at least one region of adhesion between at least one pair of adjacent bags. Preferably, at least one region of adhesion is provided between each adjacent pair of bags of the stack. The region(s) of adhesion may take the form of one or more line or spot of glue. The region(s) of adhesion is/are suitably located between the bags near the mouths of the bags. Alternatively, adhesion may be accomplished by pressure and/or heat, e.g. by mechanical, electrical or electromechanical means in conventional manner.

The region(s) of adhesion are preferably provided, on tongues of bag material which are arranged to extend away from the bag portions in the central region between the handle portions, i.e. above the general line of the rims of the bags. Conventional glues or other adhesives, such as contact adhesives or hot-melt adhesives may suitably be used, and may be applied as spots or lines in conventional manner. The glue may suitably provide a resistance to breaking between the bags in the range of about 4 to 9 Newtons.

We have found that the dispensers on which such so-called "glue-spot" stacks of bags are to be used can aggravate the problem of concertinaing or daisychaining mentioned at the beginning of this application and in GB-A-2309957.

In particular, the stack support members of the dispensers have not hitherto hindered daisychaining of the stack of bags, but on the contrary their smooth surface (particularly the upper portion of their surface on which the stack hangs) encourages sliding of the bags along the support members.

In a fourth aspect of the present invention, therefore, there is provided a dispenser for dispensing individual pre-formed bags from a stack of such bags in which adjacent bags are provided with an intermediate region of adhesion near the mouths of the bags, the dispenser comprising at least one elongate support member adapted to pass through at least one support member receiving aperture of the stack defined by corresponding portions of the stack, thereby to support the stack in use, characterised in that at least a portion of the surface of at least one elongate support member that is in operative contact with the portions of the stack that define the support member receiving aperture(s) is provided with a plurality of projections which serve in use to restrict undesired opening of bags of the stack when a first bag of the stack is pulled along the support member.

The restriction of undesired opening of bags of the stack results from the projections catching the contacting portions of those bags and thereby impeding their ability to slide along the support members unless actively pulled along by a user of the dispenser. It is preferred that the projections should be at least about 0.1 mm in height, more preferably at least about 0.2 mm and most preferably at least about 0.5 mm. We have found that regularly spaced transverse ridges are suitable. Such ridges may, for example be about 0.5 mm to about 2.5 mm apart, and spaced regularly along at least the upper surface of the or each support member.

For example, where the dispenser comprises laterally spaced elongate support members for engaging a stack of bags through support member receiving apertures, conventional threaded bolts or the like may be used as support members so that the thread provides the roughened surface of the support members.

Figure 1:
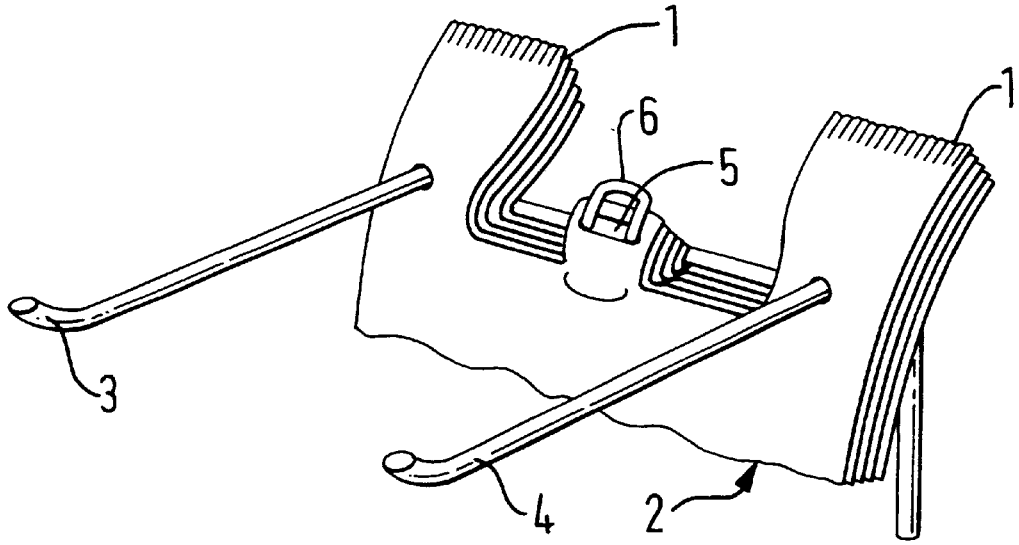
FIG. 1 PRIOR ART
FIG. 1 shows a prior art system which uses a simple system of hanging a stack of T-shirt type handle bags from two smooth horizontal rods.
Figure 2:
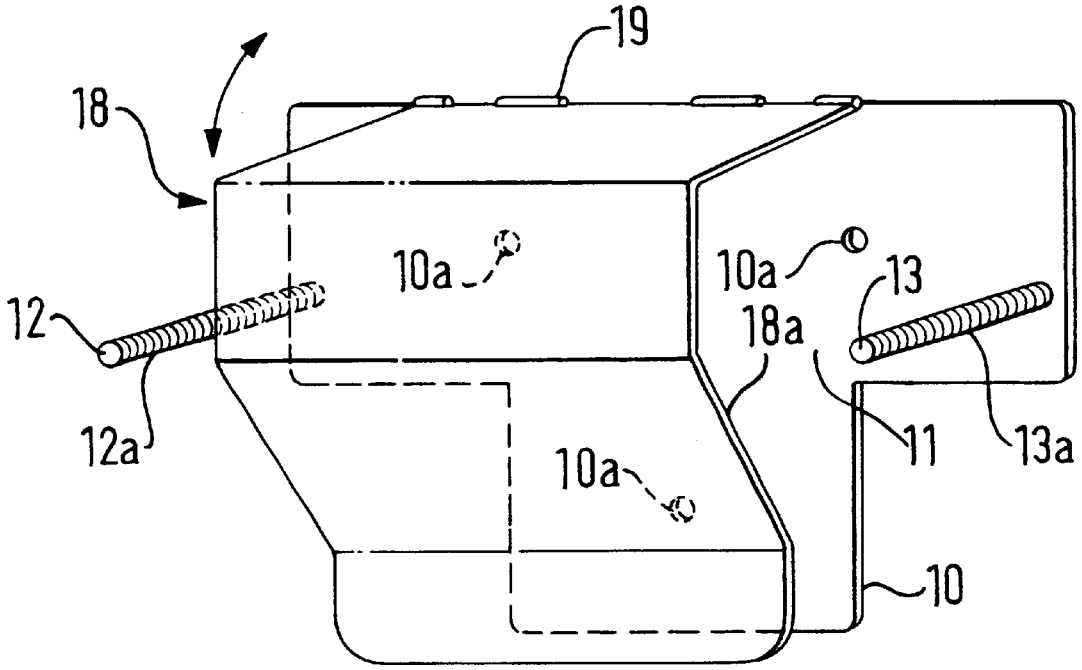
Figure 3:
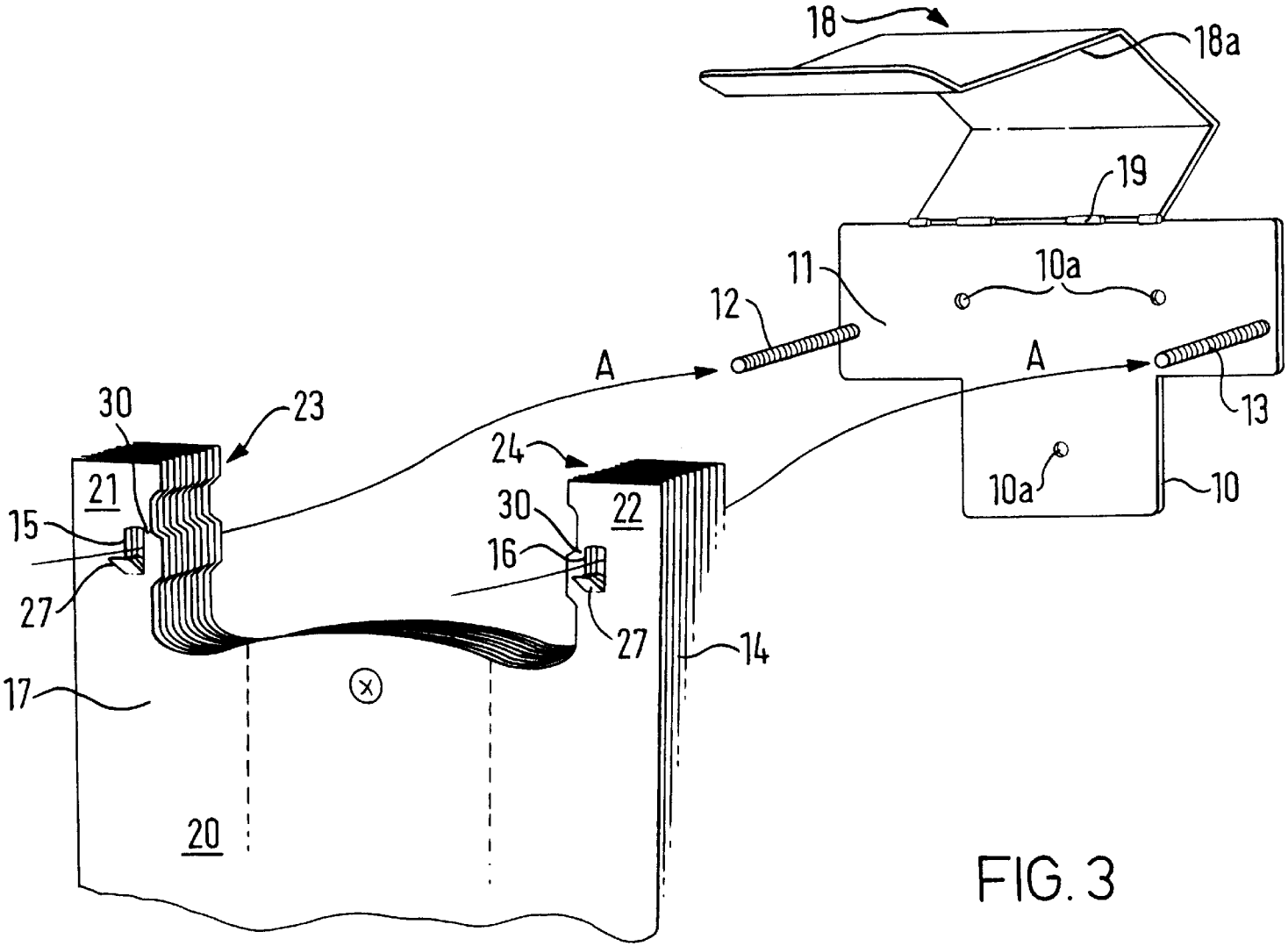
Figure 5:
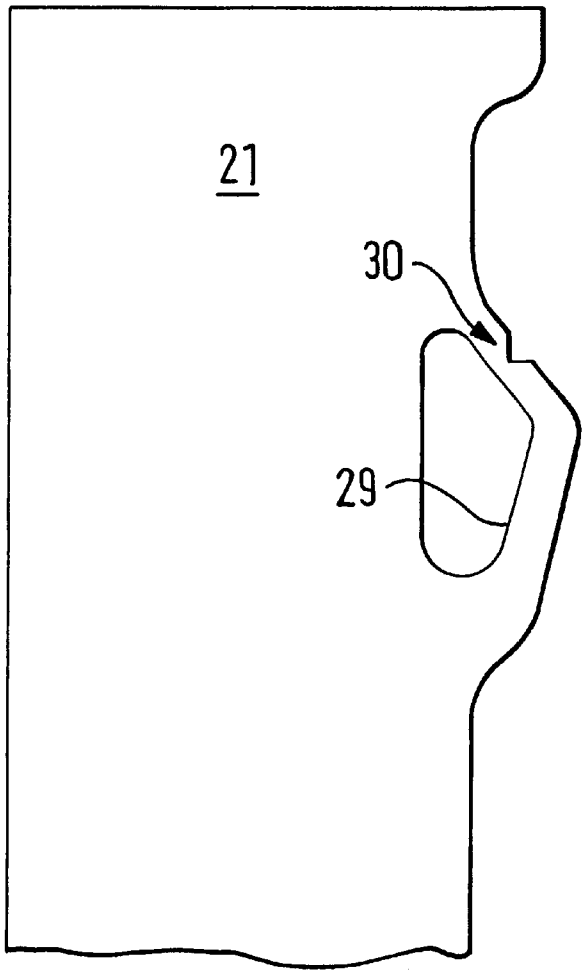
Figure 4:
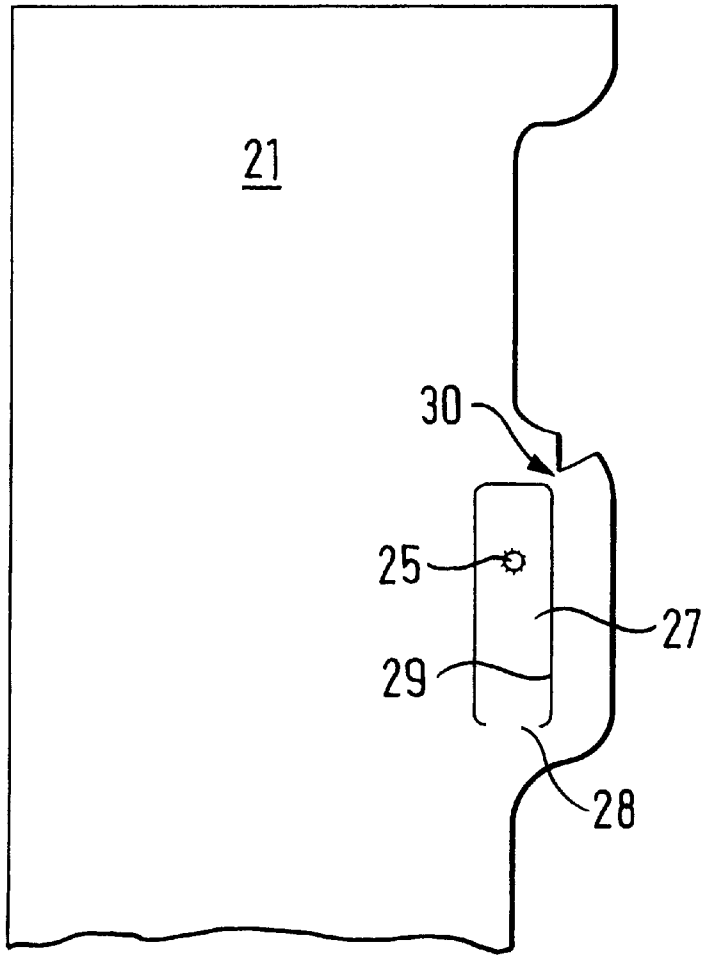
Figure 6:
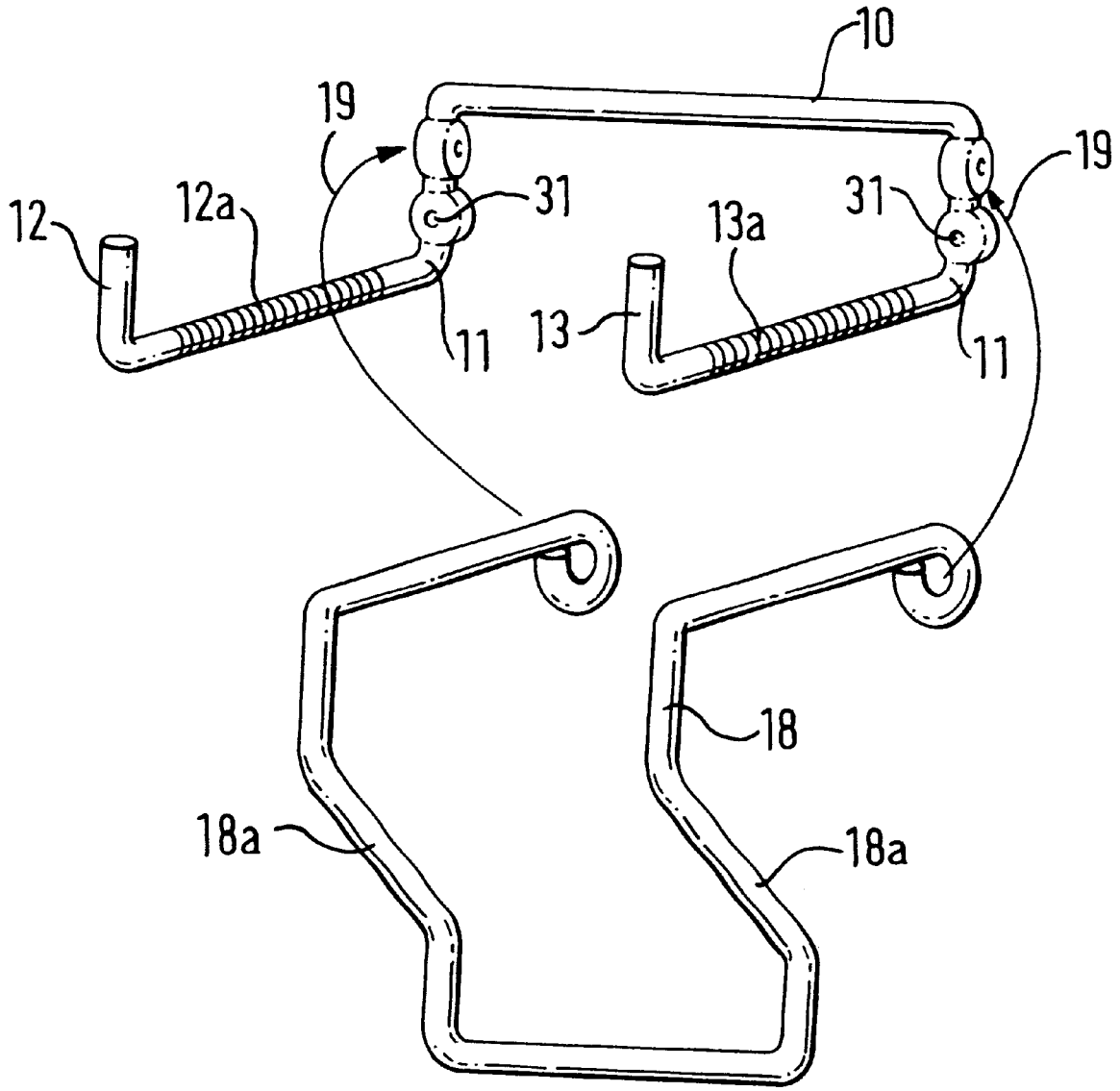

For a better understanding of the invention, and to show how the same may be carried into effect, reference will now be made, by way of example and without limitation, to FIGS. 2 to 5 of the accompanying drawings, in which:

FIG. 2 shows a perspective view of a dispenser for dispensing individual pre-formed bags from a stack of such bags, omitting the stack of bags for clarity;

FIG. 3 shows a perspective view of the dispenser of FIG. 2 in the process of being loaded with a stack of bags;

FIG. 4 shows a detailed view of one handle stack of the stack of bags appearing in FIG. 3;

FIG. 5 shows a detailed view of one handle stack of an alternative stack of bags usable with the dispenser of FIG. 2; and FIG. 6 shows a perspective disassembled view of an alternative dispenser for dispensing individual pre-formed bags from a stack of such bags, omitting the stack for clarity.

DETAILED DESCRIPTION OF THE DRAWINGS

Referring firstly to FIGS. 2 to 4, there is shown a dispenser for dispensing individual pre-formed bags from a stack of such bags, the dispenser comprising a body part 10, and an anchor part 11 for the stack. The dispenser is mounted on a wall or other surface (not shown) by screws (not shown) passing through screw holes 10*a*. The anchor part is integral with, or fixed to, the body part, the whole being constructed in sheet metal.

The anchor part comprises forwardly projecting catch means for engaging a stack 14 of pre-formed bags, whereby the stack depends from the catch means. The catch means is a pair of forwardly projecting support members in the form of metal prongs 12,13, spaced laterally on the anchor part 11. These prongs 12, 13 are received in a pair of apertures 15, 16 of the stack 14, as shown in FIG. 3 and described in more detail below. The prongs 12, 13 are provided with surface projections 12*a*, 13*a* in the manner of threaded bolts, to restrict undesired opening of the bags of the stack during use (the so-called concertina or daisychaining effect).

The dispenser further comprises a stack restraining means which bears against the engaged stack of bags (see FIG. 2) to restrain the stack. The stack restraining means is adapted to permit a front wall 17 of a first bag of the stack to be drawn past the stack restraining means to open the bag prior to removal from the dispenser. This effect is accomplished by constructing the stack restraining means as a relatively heavy restraining member 18, in the form of a metal plate, which is hinged to the body part 10 via hinges 19 in such a way that the restraining member 18 can bear against the engaged stack 14 of bags in the region of the bag mouths.

A first portion 18*a* of the restraining member 18 is kinked rearwardly, whereby it is maintained at a fixed angle with respect to the remainder and the first portion 18*a* of the restraining member 18 is thereby directed preferentially towards the stack to restrain the same. The first portion 18*a* is preferably provided centrally between the prongs 12, 13, to coincide with the central region X of the mouths of the bags.

The restraining member 18 includes a right-angled bend so that it overlies and masks substantially all of the top portion of the stack 14 of bags adjacent to the anchor part 11 when the dispenser is in use (FIG. 2). In this way the portion of the stack of bags that is between the prongs 12,13 is substantially invisible and relatively inaccessible during use.

The restraining member 18 is hinged to the body part 10 via hinges 19, the hinge axis lying above the bags and behind the hanging plane of the bags. As shown in FIG. 3, this enables the restraining member 18 to be moved clear of and away from the anchor part 11, so allowing access to the prongs 12, 13 when engaging the stack 14 of bags thereon.

The stack 14 of bags will now be described in detail, with particular reference to FIGS. 3 and 4. It is to be understood that the stack of bags can be used with many conventional types of dispenser, and not merely the type illustrated in FIGS. 3 and 6.

The stack 14 is of generally conventional construction for T-shirt or singlet type plastic bags without a block header bridging the handles or extending centrally from the mouth of the bags.

Each bag of the stack, when lying flat in the stack, comprises a body portion 20 and two side handle portions 21, 22 extending therefrom.

Each bag comprises front and rear gusseted walls, a closed bottom and an open mouth top portion. The bags are positioned in the stack with the corresponding handles of the pair of handles of each bag in stacked aligned overlying relation forming a pair of handle stacks 23, 24 associated with the stacked bags.

The pair of aligned apertures 15, 16 is provided through the pair of handle stacks 23, 24 for receiving each handle stack on a corresponding one of prongs 12 and 13 (see FIG. 3).

As shown particularly in FIG. 4, the handles in each handle stack 23, 24 are retained together for maintaining the apertures 15, 16 in alignment by bag retaining means consisting of a flap 27 within each aperture of each bag integral with the respective bag at a minor region 28 on the periphery 29 of the aperture. The flap 27 is releasably secured to the adjacent flap(s), for retention of the flaps in overlying aligned relation. The releasable securement of the adjacent flaps together is such that the flaps themselves are not severed during the action of removal of a bag from the dispenser. This is achieved by a serrated punch "weld" 25, which causes the flaps to secure releasably together by means of the deformation caused by the punch. The securement between adjacent flaps is weaker than the breaking strength of the web connecting the flap 27 to the handle 21 of the bag to be detached. This has the desirable result that no waste bag material is left on the dispenser or the last bag of the stack.

A discrete region of weakness 30 is provided in each handle stack 23, 24 between the periphery 19 of the apertures and the inwardly directed side of the handles 21, 22, and near the top of the apertures. The region of weakness takes the form of a localised narrowing of the web of bag material between the periphery of the respective aperture and the inwardly directed side of the handle.

In an alternative, but less preferred arrangement, the bond between adjacent flaps can be made stronger by conventional means, so that the bond is stronger than the breaking strength of the web connecting the flaps 27 to the handle 21 of the bag to be detached. Such a modification may be acceptable environmentally, as there is still no redundant block of bag material left on the dispenser after removal of the last bag, although there can be a block of flaps 27 on the handles of the last bag of the stack when it is removed from the dispenser.

If desired, a conventional hot pin weld or the like can also be applied through each handle stack 23, 24 for example in the region occupied by the reference numeral "21" in FIG. 4. It is preferred that such a weld would releasably secure adjacent handles together prior to removal of the respective bag from the stack, while yet leaving no residual material from the handle of the top bag of the stack after the weld between that top bag and the remainder of the stack has been broken on removal of the top bag from the stack.

Referring now to FIG. 5, an alternative design of handle is shown, which may be employed in place of the handle cut lines shown in FIGS. 3 and 4. Like parts are denoted alike in FIGS. 4 and 5.

In particular, in FIG. 5 the flap 27 is absent and an open aperture through the handle stack is provided to receive the prongs 12, 13.

The stacks of bags illustrated in FIGS. 3 to 5 are manufactured in generally conventional manner, as has been described above.

The cutting of the open mouth top portion and the handles of the bags from the stack of double end-sealed bag-forming enclosures may suitably be achieved by a method (not shown) in which at least a portion of the cutting blade is provided with surface serrations extending at an angle away from the direction of application of the blade to the stack, to cause the material of one bag in a region adjacent the resulting cut to at least partially snag or foul the material of a neighbouring bag at the edges 29 of the support member receiving apertures and of the handle portions 21, 22 (i.e. notably the inwardly directed, cut, edges), whereby at least some of the bags of the stack are releasably secured together by this snagging or fouling.

The stack of bags is provided with a region of adhesion between each pair of adjacent bags (not shown). The region of adhesion takes the form of a spot of glue located between the bags near the mouths of the bags, in the region marked X in FIG. 3. Conventional glues such as contact adhesives are used, and are applied as spots in conventional manner.

To load the stack 14 of bags onto the dispenser the restraining member 18 is lifted into an upright position and the apertures 15, 16 of the stack offered up onto the prongs 12, 13 of the dispenser (arrows A in FIG. 3), to engage the stack of bags on the prongs 12, 13. Each block of flaps 27 is pushed out of the way to open the apertures 25, 26 for this purpose, although the flaps are not at this stage released from securement to adjacent flaps. In this regard, it is to be noted that the mutually releasably connected flaps, which are themselves in a block, will easily fold down and out of the way of the prongs 12,13—still in a block—as the stack is offered up to the dispenser.

After the stack of bags is in place it is allowed to hang and the restraining member 18 is moved down into the operative position (FIG. 2) in which the first portion 18*a* will bear against the stack.

The first bag of the stack is then opened by hand. The restraining member 18 restrains the trailing side of the bag to the remainder of the stack, roughly in the location of region X (i.e. the glue spot between the adjacent bags). The first bag is then loaded with items of shopping.

When the region of adhesion between the bag being removed and the next bag of the stack causes the leading side of the said next bag to be drawn past the restraining member to open the mouth of the said next bag, the restraining member 18 lifts to accommodate this movement and then falls back to restrain the trailing side of the said next bag, so preventing the concertina or daisychaining effect described in GB-A-2309957.

When the bag is fully loaded, it is pulled downwards to break the region of weakness 30 of each handle and to break the securement between the flaps 27 of that bag and the adjacent flaps of the stack, to release the bag from the dispenser and leave the next bag ready for use. Alternatively, the first bag can if desired be pulled from the dispenser in the same way, before loading.

Thus, when the adhesive bond X, the securement between adjacent flaps and the region of weakness 30 are broken, and the bag being removed becomes completely detached, the mouth of the next bag is found to be opened in a surprisingly effective and convenient manner, with the rear wall of the mouth restrained at the rim to the remainder of the stack by the restraining member 18.

Referring finally to FIG. 6, an alternative construction of the dispenser is shown, in which the parts are formed of folded metal rods hinged together by means of a conventional screw or bolt forming the hinge pin. Like parts are designated as for FIG. 2. The dispenser may be mounted to a vertical surface by means of screws (not shown) passing through screw holes 31 in conventional manner. Hinges are formed between the parts 18 and 10 by conventional pins (not shown) when the parts are brought together as shown by arrows 19 in FIG. 6.

The foregoing broadly describes the present invention without limitation to particular embodiments. Variations and modifications as will be readily apparent to those skilled in this art are intended to be included within the scope of this application and resulting patent(s).

What is claimed is:

1. A stack of individual pre-formed bags for use with bag dispensers of the type in which at least one elongate support member of the dispenser passes in use through at least one support member receiving aperture of the stack defined by corresponding portions of the stack and thereby supports the stack, the stack comprising a plurality of stacked T-shirt type bags, each bag comprising front and rear walls, a closed bottom and an open mouth top portion; the top portion having a pair of spaced loop handles as integral extensions of the walls at opposite sides of the mouth; the plurality of stacked bags being positioned with the corresponding handles of the pair of handles of each bag in stacked aligned overlying relation forming a pair of handle stacks associated with the stacked bags; and aligned support member receiving apertures being provided through the handles of at least one handle stack for reception of the respective handle stack on a corresponding support member of the dispenser receivable through the aligned apertures; the handles in the respective handle stack being retained together for maintaining the apertures in alignment by flaps within the apertures of each bag of the handle stack integral with the respective bag at a minor region on the periphery of the apertures, wherein the flaps of the apertures of one bag in the handle stack are releasably secured to the flaps of the apertures of the adjacent bags, for retention of the flaps in overlying aligned relation prior to removal of a bag from the dispenser, and for release of the flaps of a first bag of the stack from the flaps of the remainder of the stack on pulling the bag away from the stack, the securement of the adjacent flaps permitting release at the point of securement on manual separation of the respective bags.

2. A stack of pre-formed bags according to claim 1, wherein the front and rear walls of each bag are gusseted.

3. A stack of pre-formed bags according to claim 1, wherein the open mouth portion of each bag is free of any integral extension header at the top of the front and rear walls.

4. A stack of pre-formed bags according to claim 1, wherein the aligned support member receiving apertures are provided through the handles of each handle stack for reception of each handle stack on a corresponding support member of the dispenser receivable through the aligned apertures.

5. A stack of pre-formed bags according to claim 1, wherein each handle stack has an inwardly directed side and an outwardly directed side relative to the other handle stack, and a base portion and an end portion respectively relatively close to and distant from the walls of the bag, the base portion being integral with the walls of the bag, and the support member receiving apertures of each handle stack are provided nearer the inwardly directed side of the respective handle stack than the outwardly directed side thereof.

6. A stack of pre-formed bags according to claim 5, wherein the support member receiving apertures of each handle stack are provided generally intermediate between the base and the end portions of the handle stack.

7. A stack of pre-formed bags according to claim 1, wherein the flaps of the apertures have a length to width ratio of at least about 1:1.

8. A stack of pre-formed bags according to claim 7, wherein the ratio is between about 2:1 and about 6:1.

9. A stack of pre-formed bags according to claim 1, wherein the flaps are releasably blunt-through edged punch welded or serrated punch welded together, whereby the releasable mutual securement of the flaps is provided by the deformation caused by the punch.

10. A stack of pre-formed bags according to claim 1, wherein the minor region of integrality between each flap and its respective bag is preferentially weaker than the securement between the adjacent flaps, whereby the minor region of integrality will tend to break when a bag is detached from the stack, the releasable securement of the flaps serving to prevent accumulation of a block of all of the broken-off flaps on the stack of bags as bags are detached from the stack.

11. A stack of individual pre-formed bags for use with bag dispensers of the type in which at least one elongate support member of the dispenser passes in use through at least one support member receiving aperture of the stack defined by corresponding portions of the stack and thereby supports the stack, the stack comprising a plurality of stacked T-shirt type bags, each bag comprising front and rear walls, a closed bottom and an open mouth portion; the top portion having a pair of spaced loop handles as integral extensions of the walls at opposite sides of the mouth; the plurality of stacked bags being positioned with the corresponding handles of the pair of handles of each bag in stacked aligned overlying relation forming a pair of handle stacks associated with the stacked bags; and aligned support member receiving apertures being provided through the handles of at least one handle stack for reception of the respective handle stack on a corresponding support member of the dispenser receivable through the aligned apertures; the handles in the respective handle stack being retained together for maintaining the apertures in alignment; wherein no residual material is left detached from the handle of one bag on pulling the said one bag away from its neighbor in the stack, and the handles in the respective handle stack are retained together in alignment by flaps within the aperture of each bag integral with the respective bag at a minor region on the periphery of the aperture, the flaps being secured to the flaps of the apertures of the adjacent bags for retention of the flaps in the overlying aligned relationship; wherein at least one discrete region of weakness is provided in each handle of the respective handle stack between the periphery of the support member receiving aperture and the side or end of the handle whereby on pulling a bag from the dispenser the material of the bag breaks at the at least one region of weakness in the handle to detach the handle of the bag from the support member of the dispenser.

12. A stack of individual pre-formed bags for use with bag dispensers of the type in which at least one elongate support member of the dispenser passes in use through at least one support member receiving aperture of the stack defined by corresponding portions of the stack and thereby supports the stack, the stack comprising a plurality of stacked T-shirt type bags, each bag comprising front and rear walls, a closed bottom and an open mouth portion; the top portion having a pair of spaced loop handles as integral extensions of the walls at opposite sides of the mouth; the plurality of stacked bags being positioned with the corresponding handles of the pair of handles of each bag in stacked aligned overlying relation forming a pair of handle stacks associated with the stacked bags; and aligned support member receiving apertures being provided through the handles of at least one handle stack for reception of the respective handle stack on a corresponding support member of the dispenser receivable through the aligned apertures; the handles in the respective handle stack being retained together for maintaining the apertures in alignment; wherein no residual material is left detached from the handle of one bag on pulling the said one bag away from its neighbor in the stack, and the handles in the respective handle stack are retained together in alignment by flaps within the aperture of each bag integral with the respective bag at a minor region on the periphery of the aperture, the flaps being releasably secured to the flaps of the apertures of the adjacent bags for retention of the flaps in the overlying aligned relationship; wherein at least one discrete region of weakness is provided in each handle of the respective handle stack between the periphery of the support member receiving aperture and the side or end of the handle whereby on pulling a bag from the dispenser the material of the bag breaks at the at least one region of weakness in the handle to detach the handle of the bag from the support member of the dispenser.

13. A stack of pre-formed bags according to claim 12, wherein the releasable securement of the flaps permits release at the point of securement on manual separation of the respective bags.

14. A stack of pre-formed bags according to claim 12, wherein the minor region of integrality between each flap and its respective bag is preferentially weaker than the securement between the adjacent flaps, whereby the minor region of integrality will tend to break when a bag is detached from the stack.

15. A stack of pre-formed bags according to claim 12, wherein the releasable securement of the flaps permits release at the point of securement on manual separation of the respective bags, and wherein further the minor region of integrality between each flap and its respective bag is preferentially weaker than the securement between the adjacent flaps, whereby the minor region of integrality will tend to break when a bag is detached from the stack, the releasable securement of the flaps serving to prevent accumulation of a block of all of the broken-off flaps on the stack of bags as bags are detached from the stack.

16. A stack of individual pre-formed bags for use with bag dispensers of the type in which at least one elongate support member of the dispenser passes in use through at least one support member receiving aperture of the stack defined by corresponding portions of the stack and thereby supports the stack, the stack comprising:

a) a plurality of stacked T-shirt type bags, each bag comprising front and rear walls, a closed bottom and an open mouth portion;

b) the top portion having a pair of spaced loop handles as integral extensions of the walls at opposite sides of the mouth;

c) the plurality of stacked bags being positioned with the corresponding handles of the pair of handles of each bag in stacked aligned overlying relation forming a pair of handle stacks associated with the stacked bags; and d) aligned support member receiving apertures being provided through the handles of at least one handle stack for reception of the respective handle stack on a corresponding support member of the dispenser receivable through the aligned apertures;

wherein the handles in the respective handle stack are retained together for maintaining the apertures in alignment in such a way that no residual material is left detached from the handle of one bag on pulling the said one bag away from its neighbour in the stack; said handles being retained together for maintaining the apertures in alignment by flaps within the apertures of each bag integral with the respective bag at a minor region on the periphery of the aperture, the flaps being secured to the flaps of the apertures of the adjacent bags for retention of the flaps in overlying aligned relationship; and wherein at least one discrete region of weakness is provided in each handle of the respective handle stack between the periphery of the support member receiving aperture and the side or end of the handle whereby on pulling a bag from the dispenser the material of the bag breaks along a line of rupture extending between the periphery of the support member receiving aperture and the side or end of the handle to detach the handle of the bag from the support member of the dispenser.

17. A stack of individual pre-formed bags according to claim 16 wherein the flaps are releasably secured to the adjacent flaps.

* * * * *